US005505233A

United States Patent [19]

Roberts et al.

[11] Patent Number: 5,505,233

[45] Date of Patent: Apr. 9, 1996

[54] MOBILE AND FLUSHABLE CONTAINER FILLING UNIT

[75] Inventors: Terence P. Roberts, Burnsville; Karl J. Fritze, Brooklyn Center, both of Minn.

[73] Assignee: Neupak, Inc., Burnsville, Minn.

[21] Appl. No.: 388,166

[22] Filed: Feb. 10, 1995

Related U.S. Application Data

[63] Continuation of Ser. No. 148,877, Nov. 8, 1993, abandoned.

[51] Int. Cl.[6] ..... B65B 3/00

[52] U.S. Cl. ..... 141/83; 141/92; 141/231; 141/242

[58] Field of Search ..... 141/83, 115, 128, 141/231, 237, 242–244, 92; 222/608

[56] References Cited

U.S. PATENT DOCUMENTS

| | | | |
|---|---|---|---|
| 2,750,091 | 6/1956 | Mattimoe et al. | 141/83 X |
| 2,948,306 | 8/1960 | Kuraeff | 141/231 |
| 3,921,682 | 11/1975 | McGahey et al. | 141/128 |
| 4,195,672 | 4/1980 | Freeman | 141/231 X |
| 4,305,437 | 12/1981 | Greene | 141/231 X |
| 4,337,802 | 7/1982 | Kennedy et al. | 141/128 X |
| 4,390,049 | 6/1983 | Albertson | 141/92 |
| 4,411,295 | 10/1983 | Nutter | 141/237 X |
| 4,641,693 | 2/1987 | Rakucewicz | 141/231 X |
| 4,651,788 | 3/1987 | Grosskreuz et al. | 141/83 |
| 4,819,700 | 4/1989 | Sommer et al. | 141/83 X |
| 5,016,687 | 5/1991 | Kawamura | 141/115 X |
| 5,105,859 | 4/1992 | Bennett et al. | 141/237 X |
| 5,148,841 | 9/1992 | Graffin | 141/83 |
| 5,234,035 | 8/1993 | Neeser | 141/231 X |

*Primary Examiner*—J. Casimer Jacyna
*Attorney, Agent, or Firm*—Palmatier, Sjoquist & Helget

[57] ABSTRACT

A container filling unit moveable from a filling position to cleaning, non-use or ready to use positions including a base and a vertically adjustable mast, which mast provides a manifold and valving system for a single or plurality of filling heads for the precise filling of containers. The unit includes a valving arrangement which provides for full or rapid flow, reduced or slow flow and positive shut-off of flow with the flows being controlled in response to weight or volume of material delivered to the container. The unit includes a turbulence reducing discharge head which includes a positive material shut-off. The unit is useable for surface and subsurface filling and a primary aspect of the invention is to initially fill containers at a rapid rate and thereafter provide a slower filling rate to insure accurate and precise filling. Moveability of the unit allows shifting of the unit from its use, filing location to a cleaning, non-contaminating, controlled conditions location or to a non-use, ready for use location.

7 Claims, 5 Drawing Sheets

MOBILE AND FLUSHABLE CONTAINER FILLING UNIT

RELATED APPLICATIONS

This application is a continuation application under 37 C.F.R. §1.62 based upon a pending U.S. application Ser. No. 08/148,877 filed Nov. 8, 1993, now abandoned, originally titled CONTAINER FILLING UNIT on file in the U.S. Patent Office by the inventors or assignee hereof.

FEDERAL SPONSORSHIP

This invention is not made under any Federally sponsored research or development arrangement nor under any other independently sponsored research and development arrangement.

FIELD OF THE INVENTION

This invention relates generally to devices for the filling of containers with liquids and more particularly to a single or multiple filling head unit having flow control valves to provide rapid material flow to the container to a first amount of material and thereafter continuing flow at a reduced rate to bring the container to the desired material amount. The unit is moveable from a container filling position to a cleaning location and to a non-use or ready-to-use location.

SUMMARY OF THE INVENTION

A container filling unit which is mobile for tranport between various positions for the filling of containers and for cleaning such that a cleaned unit may always be ready for filling use. Although the applicants refer to paint as the material being filled, the invention is not limited to paint but is equally applicable to any fluid. The unit is mobile to allow the same to be brought to the container filling area for filling a selected number of containers and after filling, the device is moveable to a cleaning area, non-use area or similarly a ready-to-use area, after cleaning.

For example, if the material being dispensed is paint, it is essential that cleaning materials and paint materials not be mixed or the paint area contaminated by cleaning material. Similarly waste disposal of various materials is controlled by legislation and certain standards must be met which are best accomodated by controlled area cleaning. Therefore cleaning of the unit at a remote location is often desireable and necessary.

The unit, as illustrated and described, includes a wheeled base section having a vertically adjustable mast carrying a material delivery manifold having at least one discharge end which is provided with a dispenser head with a plurality of flow valves controlling flow to and from the manifold to the dispenser head. The flow control valves provide for discharge of material at an initial rapid rate until the container is filled to a first condition and thereafter provide discharge at a reduced rate which, if often referred to herein as a "dribble" rate. In the form shown, the valve which controls final discharge of material into the container is termed a shower-head valve which reduces turbulence or foaming during fill. This valve includes positive closure means to prevent any drippage of material.

All of the valves utilized in the illustrated and described unit are pneumatically operated and are controlled through solenoids with the control of the same being through a weight or load cell and associated equipment which responds to the weight of material delivered to the container and takes allowance for the tare or weight of the container.

The unit described including the various controls is equally useable with volumetric controlled filling.

With the mast and manifold vertical adjustability, filling may be accomplished with either above or below surface discharge.

The unit is mobile for several purposes. Paint as well as other materials should not be contaminated by cleaning fluids and with the mobile unit provided, the same is easily moved to an area remote from the filling area for cleaning.

The applicants' unit, through its manifold and valve controlled filling system provides for the filling of a single or selected plurality of containers with the entire delivery of material being precisely controlled.

BACKGROUND AND OBJECTS OF THE INVENTION

The applicants provide a mobile, filling and easily cleanable unit for the filling of containers with various fluid materials such as paint to a desired fill, whether determined volumetrically or by weight, which thereafter provides for moving the same to a remote cleaning area. By the user having at least two of such units, it should be obvious that one unit may be in use while the other is being cleaned and readied for operation. This will substantially reduce or virtually eliminate down time for the filling operation.

Not only paints, but various other materials require precise container filling to a specific weight or volume and this unit is useable for either requirement.

Applicants illustrate and describe a filling unit which provides for rapid flow of material during a first portion of the filling cycle with controls and associated equipment controlling material flow during a second portion of the filling cycle to reduce material flow for filling of the container to the desired weight or volume. Final or reduced flow is controlled through what is known as a dribble or slow flow rate valve which provides a substantially reduced flow rate to bring the delivered material precisely to the required weight or volume.

In the form illustated and described, the material flow sustem includes, at least, a manifold which permits filling one or a plurality of containers, a high rate of flow valve, a slow rate of flow valve and a final material discharge valve which may be operated below or above the surface of the material that has been delivered to the container and which will also provide reduced turbulence filling. This latter aspect is particularly important when filling containers with foamable products.

It is therefore an object of the applicants' invention to provide a filling and cleanable unit for the delivery of various liquids to a selected number of containers with the unit being easily moved from a filling area to a cleaning area.

It is a further object of the applicants' invention to provide a filling and cleanable, mobile unit, for the filling of paint cans and the like wherein a manifold is provided with at least a pair of discharge heads for filling at least a pair of containers.

It is still a further object of the applicants' invention to provide a filling and cleanable, mobile unit, for the filling of containers which includes a two step flow rate; the first such step being a rapid flow to reach a predetermined delivered level with the second step being a reduced rate of flow to bring the material delivered to a precise weight or volume.

It is still a further object of the applicants' invention to provide a filling and cleanable, mobile, container filling unit which includes a manifold having a plurality of discharges, each of which is provided with a shower-head valve unit which shower-head substantially eliminates material delivery turbulence and which is positively closeable when the material in the container reaches a predetermined desired weight or volume.

It is still a further object of the applicants' invention to provide a mobile, filling and cleanable container filling unit having a plurality of pneumatic, solenoid controlled valves for the discharge of material to a container wherein the pneumatic system is controlled by the solenoids, a load cell and peripheral equipment for sensing the weight of material delivered to the container including the allowance for the weight of the container.

It is still a further object of the applicants' invention to provide a mobile filling and cleanable container filling unit which is easily moved from the container filling area to an area for flushing and cleaning thereof with all of the valves being easily flushed and cleanable.

It is still a futher object of the applicants' invention to provide a filling and cleanable container filling unit having a vertically adjustable discharge which will permit above surface and below surface delivery of material.

These and other objects and advantages will more fully appear from a consideration of the accompanying drawings and description of the invention.

DISCLOSURE OF A PREFERRED FORM OF THE INVENTION

Figure 1:
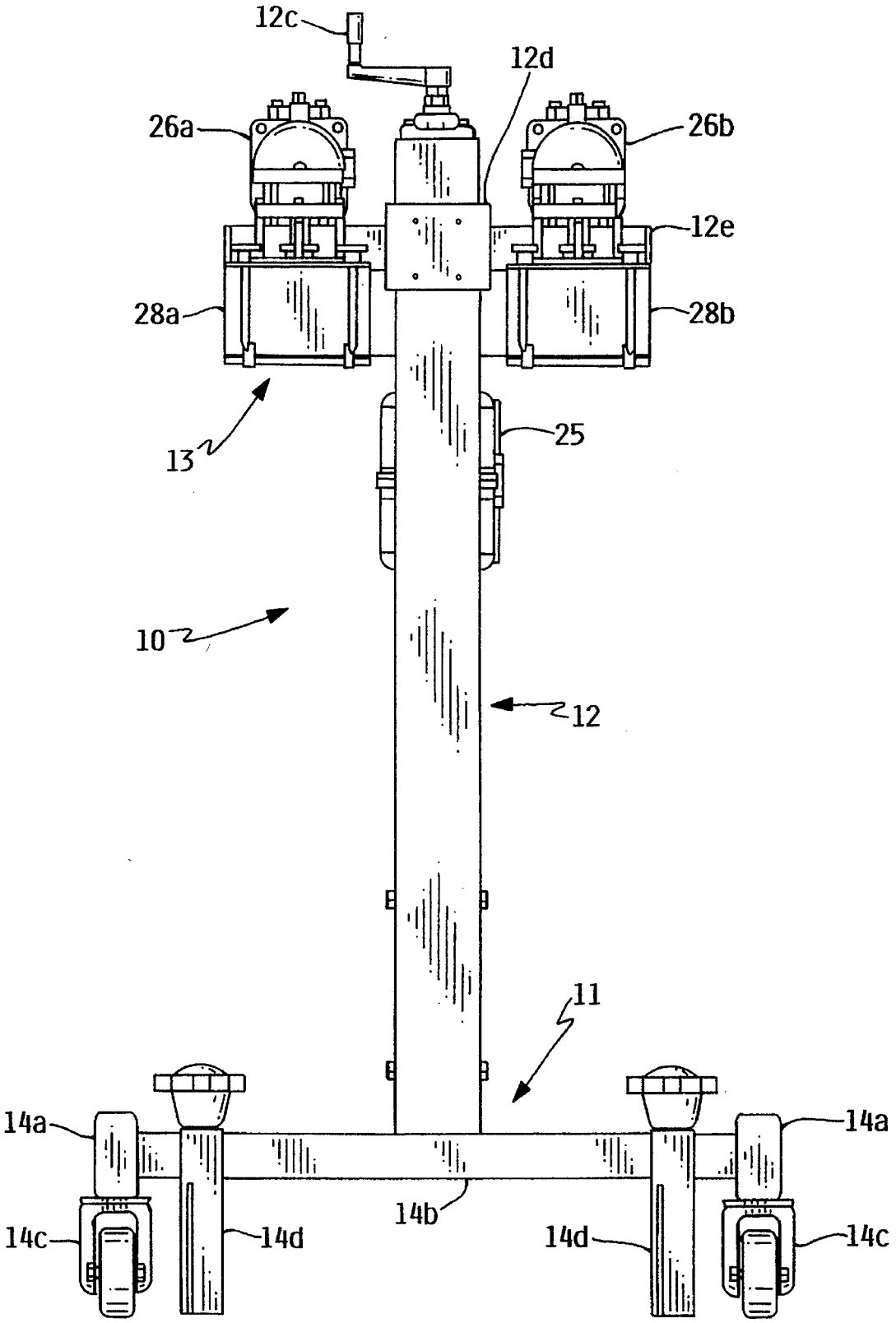
FIG. 1 is a front elevation of the container filling unit embodying the concepts of the applicants' invention.

In accordance with the accompanying drawings applicants' container filling flushing unit is generally designated 10 and basically includes a wheeled, mobile base 11, a vertically adjustable mast section 12 supported and carried by base 11 and a distributing and dispensing portion designated in its entirety 13.

Obviously, a prime function of the unit is to provide complete mobility of the unit 10 for transport between a container filling location and a flushing, cleaning location which is remote from the filling location to prevent contamination of the filling area with cleaning solvents.

In the form shown, the mobile base 11 includes a framework having side rails 14*a*–14*a* and at least one cross member 14*b*. Wheeled carriers 14*c* are provided at the ends of side rails 14*a*. As shown, a pair of elevating, floor positioning members including actuation knobs 14*d* and bases 14*e* are provided on cross elements 14*b* and such members 14*d*, 14*e* are vertically adjustable to contact a floor or other support for positively positioning the unit 10 against movement when in filling or cleaning locations.

Such an arrangement would eliminate vibration of the unit and would in effect damp the unit. A siimple modification to the unit would be the provision of attachment locations in the floor and attaching the unit thereto with screw-in elements replacing the floor psoitioning members or the unit could be attached to the coveyor upon which the containers being filled are carried. Positioning is important but the aspect of moveability is of prime importance.

Figure 7:
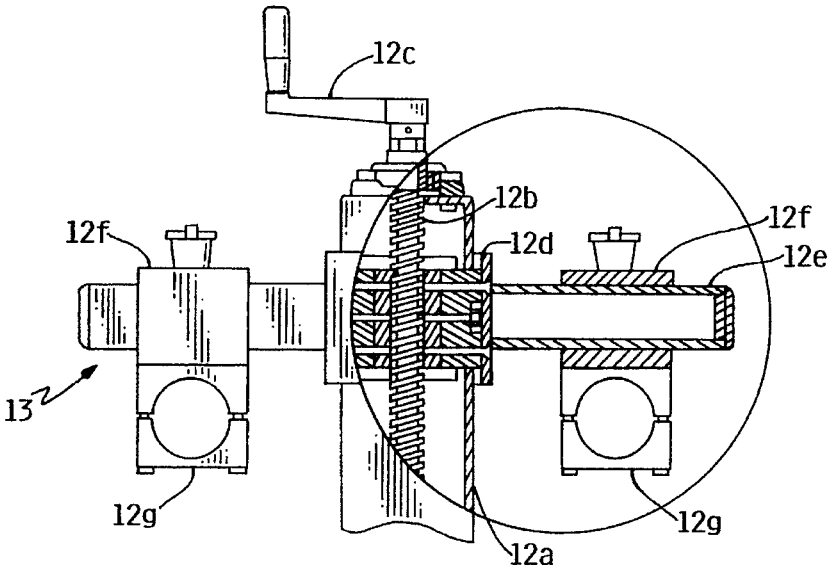
FIG. 7 is an offset vertical section of the vertically shiftable carriage assembly taken substantially along Line 7—7 of FIG. 6.
Figure 8:
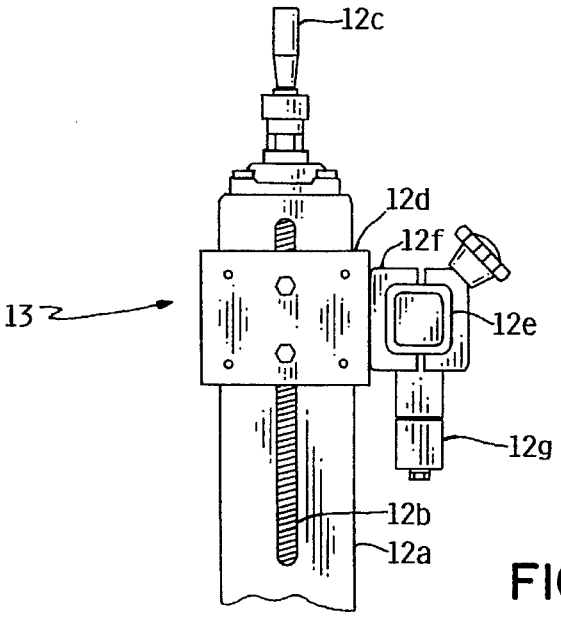
FIG. 8 is a side elevation of the encircled portion of the shiftable carriage assembly illustrated in FIG. 7; and, FIG. 9 is a schematic illustration of the product flow and control system as employed in the applicants' unit utlizing a dual container filling arrangement.

Mast section 12 includes a vertically extending, tubular member 12*a* having a threaded rod 12*b* therein with a handle member 12*c* secured to the rod 12*b* for rotation thereof which will obviously results in vertical positioning of the distributing and dispensing portion 13 which is carried by a horizontal mounting bar 12*e*. Horizontally shiftable carriers 12*f* are provided on bar 12*e*. As illustrated in FIG. 7, flow line carrier clamp devices 12*g* are provided below the carriers 12*f* and horizontal bar 12*e*. As illustrated, two such carriers 12*f* are provided for a dual flow line arrangement but this number will vary with the number of filling lines of any one unit.

It should be obvious that various forms of vertically shifting of the dispensing and distribution portion 13 with respect to the floor and with respect to the containers may be provided. The vertical adjustability of the distribution portion will also allow for positioning the final material discharge end of the unit above or below the surface of the material within the container.

The dispensing and distribution portion 13 of the unit 10 is best illustrated and described with reference to the schematic view of FIG. 9. This view combines the operation of a pneumatic supply 17, load cell 18 and associated solenoids and actuator combinations 30, 31*a*, 31*b*, 32*a*, 32*b* for the individual valves 25, 26*a*, 26*b*. 28*a*, 28*b* for delivery of material from product supply 16 to the containers C.

Figure 3:
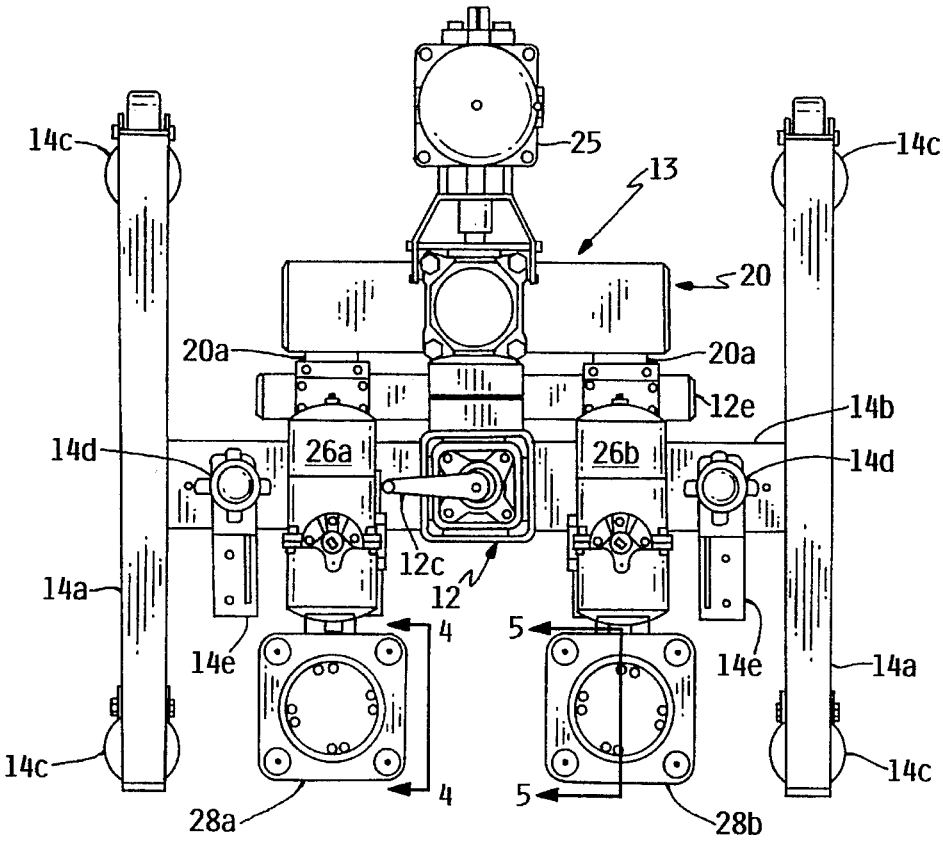
FIG. 3 is a top plan view thereof.
Figure 4:
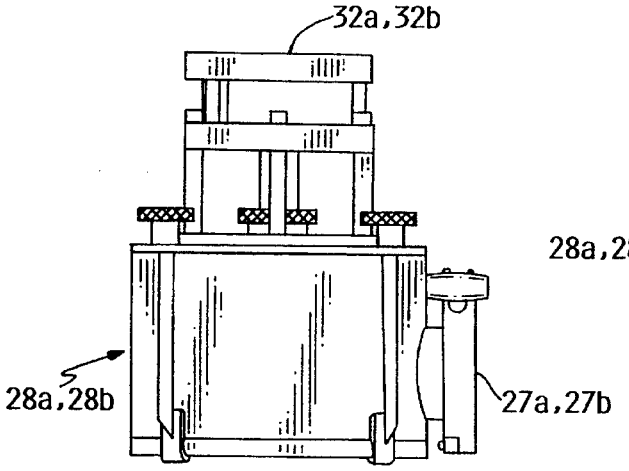
FIG. 4 is a side elevation of the material discharge valve taken substantially along Line 4—4 of FIG. 3.

As illustrated in FIG. 3, and in the form of operation selected for description, a manifold 20 is provided to receive material from a product supply 16 after the same has passed through a slow flow rate or what has been termed a "dribble" valve 25. As the illustrated unit 10 provides filling of a pair containers, two flow lines are provided to receive material from the manifold and similarly each line is controlled. For more containers, the manifold size and number of flow lines is increased.

The concept of the precise filling of containers is well known in the art and it is common to initially fill a container to a first given weight or volume at a high rate of flow and thereafter reduce the flow until the exact weight or volume of material is delivered.

Figure 9:
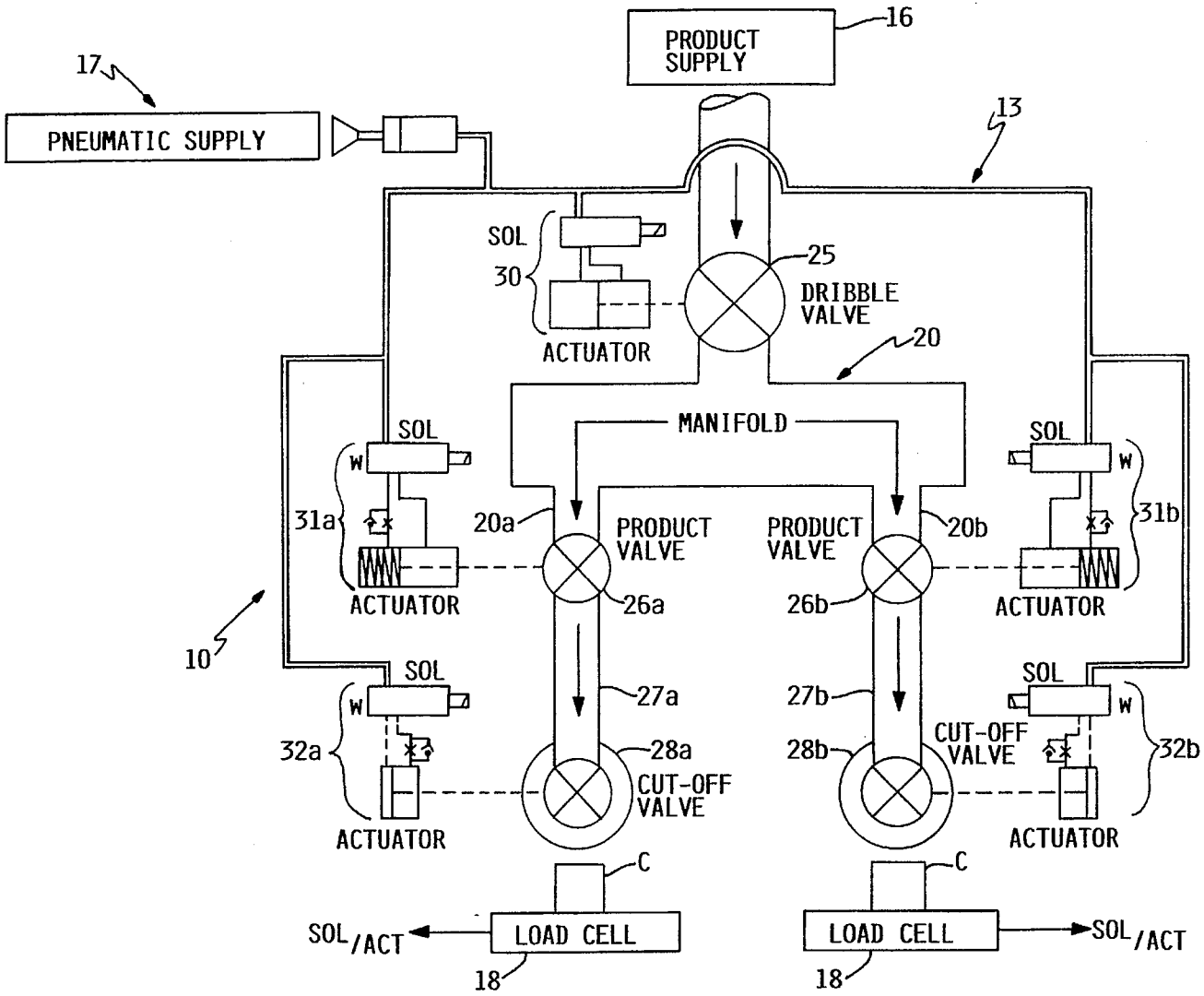

As illustrated in the dual manifold arrangement of FIG. 9, product is initially delivered from the product supply 16 through a fully open "dribble" valve 25, into and through the manifold 20 and into the discharge lines 20*a*, 20*b* exiting the manifold. Continued flow from each line is through fully open-fully closed, product control valves 26*a*, 26*b*, through additional lines 27*a*, 27*b* into and through a final discharge valve 28*a*, 28*b*.

One aspect of the invention is that initial filling of containers C takes place when all valves 25, 26*a*, 26*b*, 28*a* and 28*b* are in fully open position. As the weight or volume of the delivered material increases to a first desired level all of the valves remain in this condition. After reaching the first predetermined fill point, the slow rate, "dribble" valve actuator and solenoid combination 30 are actuated to partially close valve 25 to its slow flow rate condition. At this point the product valves 26*a*, 26*b* and discharge valves 28*a*, 28*b* remain in their fully open positions but the rate of flow of material is substantially decreased until desired delivery of material is obtained. Upon reaching the proper delivery weight, the solenoid-actuator combinations 31*a*, 31*b* controlling the product control valves 26*a*, 26*b* and combinations 32*a*, 32*b* controlling the final discharge valves 28*a*, 28*b* are shifted to bring these two sets of valves to fully closed position thereby terminating all flow to the containers C. It should be noted that the control of each line and valve combination is in response to each of the containers being filled in separate manner and filling of one container to proper level does not necessarily cut flow to the other containers.

The utilization of dribble valves or flow reducing valves is not new to the art and controls therefore are similarly not new to the art. Similarly product valves which are fully open or fully closed are not new to the art but it is the combination of total material control that is of import to this invention.

Figure 5:
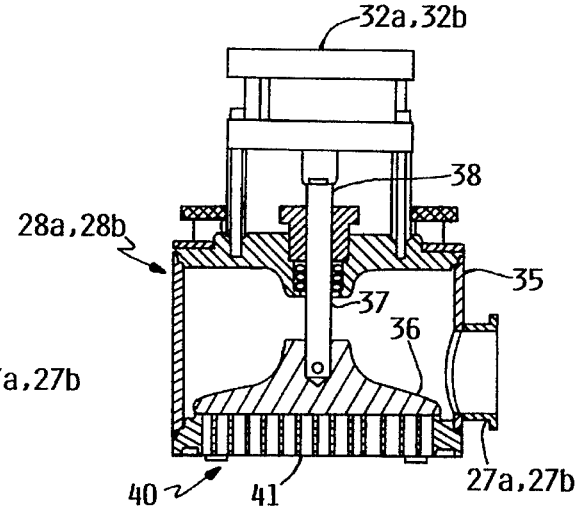
FIG. 5 is a vertical section taken substantially along Line 5—5 of FIG. 3.
Figure 6:
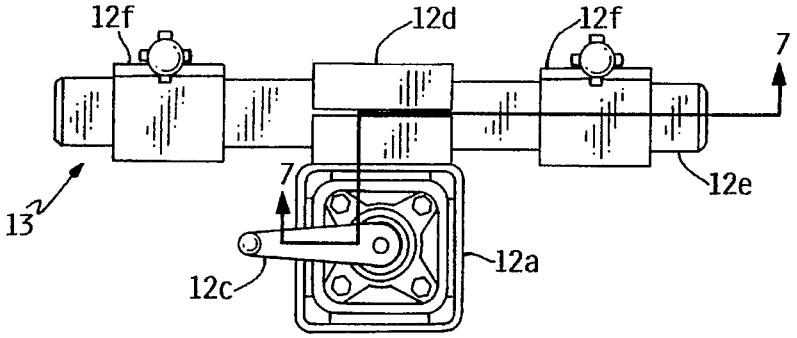
FIG. 6 is a top plan view of the vertically shiftable carriage assembly as illustrated in FIGS. 7 and 8.

In applicants' device 10 the discharge valve 28*a*, 28*b* is shown in cross section in FIG. 5. As illustrated therein valves 28*a*, 28*b* include housing 35 receiving material through flow line 27*a*, 27*b* and having a vertically shiftable closure plunger plate 36 which plunger plate 36 is controlled by and attached to a plunger rod 37 including an actuator end 38 connected to the actuator solenoid combination 32*a*, 32*b*. In order to provide a turbulence reducing, shower discharge, the lower end of housing 35 is provided with a perforate valve plate 40 having a plurality of passages 41 therethrough with one side thereof providing material discharge to to the container C when open and being positively closed by valving member 36 when the same is actuated in response to the weight of material being delivered to the container.

It should be noted that the shower valve 28*a*, 28*b* performs two functions. It prevents or reduces material turbulence and prevents dripping of material which would remain in lines 27*a*, 27*b* after closure of valves 26*a*, 26*b*. In actuality, when the plunger plate 36 is brought into its closed position against perforate valve plate 40 dripping is prevented by surface tension of the material in the perforate openings 41 through the plate 40.

Turbulence or foaming reduction is important when above surface delivery of material is utilized. To those skilled in the art, above surface delivery means that the delivery nozzle is above the surface of the material that has been delivered to the container while below surface discharge means that the delivery nozzle is below this surface. Applicants' illustrated shower nozzle is equally applicable for either above or below surface delivery and in either situation a "quiet" or gentle delivery of material results.

As stated, and in this description which is direccted to weight of material delivery, the coordination of the valve control relies upon the weight of the material delivered to the inidividual containers C. The load cell, container and delivered material is correlated such that when the empty container is positioned on the cell, allowance is automatically made for the weight of the container. When the weight of material reaches a first weight, the dribble valve 25 is brought to its partially open position to cut down the flow of material with the remaining product valves 26*a*, 26*b* and shower cutoff valves 28*a*, 28*b* remaining open. When the material delivered reaches the desired weight, the product control valves 26*a*, 26*b* and shower valves 28*a*, 28*b* are fully closed.

It should be obvious that the location of the slow rate, "dribble" valve is not controlling to the invention and its position could be shifted to the illustrated position of valves 26*a*, 26*b*.

Figure 2:
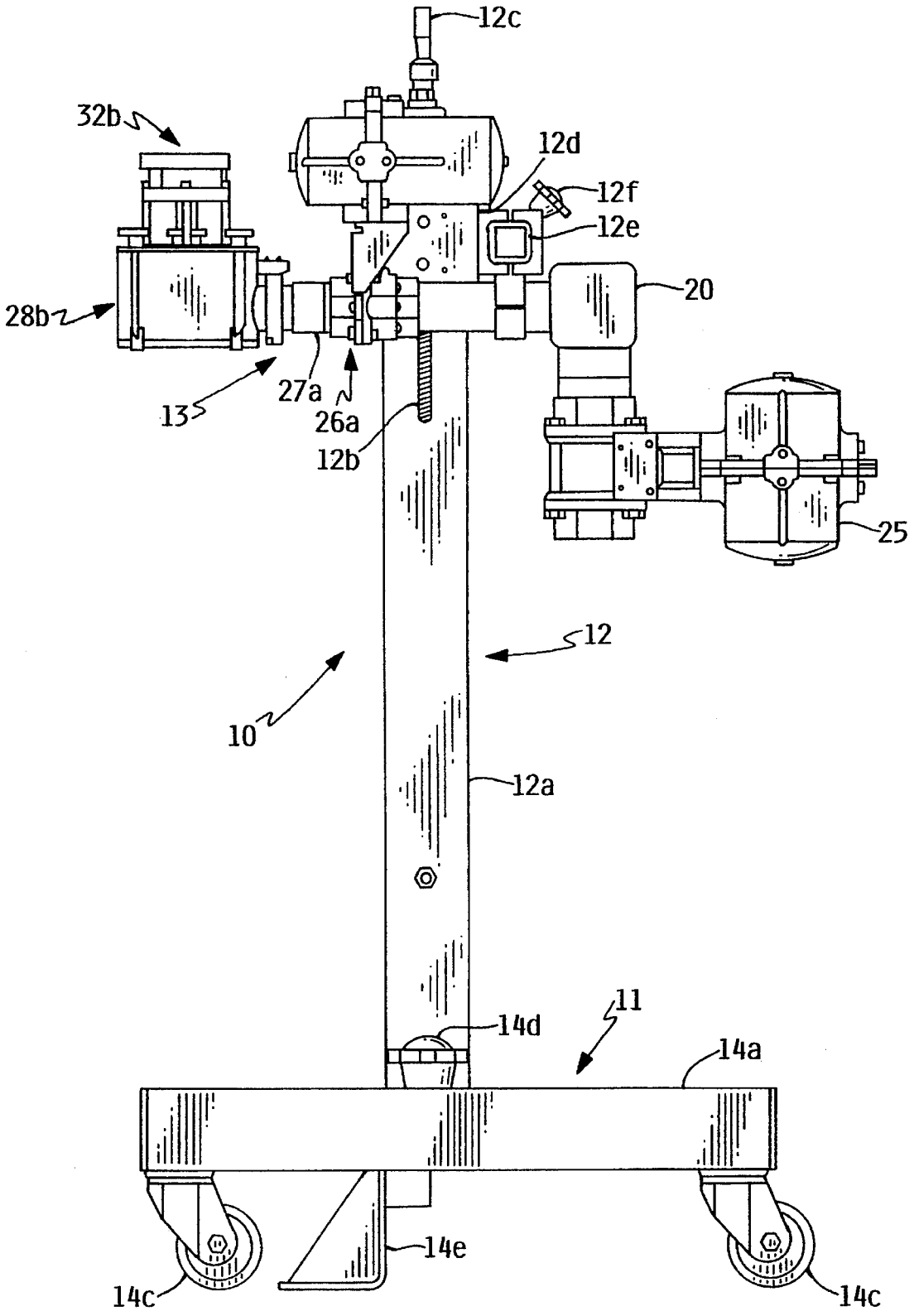
FIG. 2 is a side elevation thereof.

As illustrated in the various views, particularly FIG. 2, dispensing and delivery portion 13 includes a horizontally disposed support arm which allows for placement of dual or multiple manifolds being fed by the supply and allowing horizontal displacement of the various components thereal-long. Obviously accommodations must be made to carry the various articles such as the valves and manifold onto this moveable portion of the mast and the specific location and arrangement of the same are not pertinent to the invention, the pertinency lying in the arrangement of the valves and manifold with respect to each other, the supply and the receiving container.

After completely emptying the supply or providing for sufficient container fillage the unit 10 is shifted from filling position and a new supply and unit 10 is moved to filling position.

It should be obvious that the applicants have provided a unique filling unit which allows for its placement into a container filling area, control and delivery of material to a container or containers and removal of the entire unit to a cleaning, non-contaminating position. The valves utilized are all capable of a fully open or full flow condition and therefore clening of the unit is obtainable without valve disassembly.

It should also be obvious that mobility of the unit allows for transport of a cleaned unit to the filling location, simple connection to a proper material source and to the various sensing devices which determine the desired filling points, volumetric or weight, performance of the filling operation and thereafter total transport to a cleaning area with another clean unit being moved in for the next material filling of containers. Shut down time reduction is achieved and achievable with this unit which is not obtainable with prior art units. Although weight considerations and operations have been described volumetric filling employs the same considerations.

What is claimed is:

1. Apparatus for filling containers with liquid products, comprising:

means defining a filling position for such containers and comprising means supporting such containers, a source of the liquid product to be supplied into the containers and flow means through which the liquid product is supplied, sensing means for determining the filling of the containers, comprising a plurality of load cells, each for a separate container, first and second mobile filling units transportable relative to said filling position, said mobile filling units comprising movable floor engaging means supporting the filling units, said mobile filling units being alternately transportable to said filling position and being removable from said filling position and to a cleaning area, said first one of said filling units being in said filling position and having a connection to said source of liquid product for dispensing the liquid product into the containers and comprising a plurality of liquid product dispensing heads for filling a plurality of said containers at said plurality of load cells, and also having a connection to said sensing means to determine the filling of the liquid product into the containers, said second one of said filling units being in said cleaning area and being readied for operation and for transport to said filling position for the next filling of such containers.

2. Apparatus for filling containers with liquid products according to claim 1 wherein the floor engaging means comprise support wheels to render the filling unit mobile.

3. The apparatus for filling containers with liquid products according to claim 1 wherein the sensing means is disposed at the filling position.

4. Apparatus for filling containers with liquid products, comprising:

means for defining a filling position for such containers and comprising means supporting such containers, a source of the liquid product to be supplied into the containers and flow means through which the liquid product is supplied, sensing means for determining the filling of the containers, comprising a plurality of load cells, each for a separate container, a mobile filling unit transportable relative to said filling position and comprising support wheels rendering the filling unit mobile, said mobile filling unit being transportable to and between said filling position and a cleaning area to be cleaned and made ready for a filling operation, and further comprising a plurality of liquid product dispensing heads for filling a plurality of said containers at said load cells, the mobile filling unit being connected to said source of liquid product for dispensing the liquid product into the containers and also being connected to said sensing means when moved from the cleaning area into the filling position for filling of the containers.

5. Apparatus for filling containers with liquid products according to claim 4 wherein the mobile filling units comprise flow valves regulating flow of liquid product from the source of liquid product to the containers.

6. Apparatus for filling containers with liquid products according to claim 4 and said mobile filling unit comprising positioning means releasably retaining the mobile filling unit against movement at said filling position, and accommodating subsequent transporting of the mobile filling unit to said cleaning area.

7. Apparatus for filling containers with liquid products, comprising means defining a filling position for such containers, a source of the liquid product to be supplied into the containers and flow means through which the liquid product is supplied, sensing means comprising load cells at the filling position supporting such containers and determining the filling of the containers, means defining a cleaning area remote from said filling position for flushing and cleaning mobile filling units, first and second mobile filling units transportable relative to said filling position, said mobile filling units comprising movable floor engaging wheels supporting the filling units, said mobile filling units being transportable to said filling position and load cells and being removable from said filling position and to said cleaning area, said first one of said filling units being in said filling position and having a connection to said source of liquid product and said flow means for dispensing the liquid product into the containers and also having a connection to said sensing means to determine the filling of the liquid product into the containers, said second one of said filling units being in said cleaning area and remote from said filling position and being readied for operation and for transport to said filling position wherein the second one of the filling units will be subsequently connected to the source of liquid products and to said sensing means for the next filling of such containers, said mobile filling units comprising positioning means releasably retaining the mobile filling units against movement at said filling positions and accommodating subsequent transporting of said mobile filling units to said cleaning area.

* * * * *

US005505233B1

REEXAMINATION CERTIFICATE (3760th)

United States Patent [19] [11] B1 5,505,233

Roberts et al. [45] Certificate Issued May 11, 1999

[54] MOBILE AND FLUSHABLE CONTAINER FILLING UNIT

[75] Inventors: Terence P. Roberts, Burnsville; Karl J. Fritze, Brooklyn Center, both of Minn.

[73] Assignee: Newpak, Inc., Brownsville, Minn.

Reexamination Request:
No. 90/004,448, Nov. 8, 1996

Reexamination Certificate for:

| | |
|---|---|
| Patent No.: | **5,505,233** |
| Issued: | **Apr. 9, 1996** |
| Appl. No.: | **08/388,166** |
| Filed: | **Feb. 10, 1995** |

[21] Appl. No.: 08/388,166

Related U.S. Application Data

[63] Continuation of application No. 08/148,877, Nov. 8, 1993, abandoned.

[51] Int. Cl.[6] ..... B65B 3/00

[52] U.S. Cl. ..... 141/83; 141/92; 141/231; 141/242

[58] Field of Search ..... 141/83, 115, 128, 141/231, 237, 92, 242–244, 89, 91, 248; 222/608

[56] References Cited

U.S. PATENT DOCUMENTS

| | | | |
|---|---|---|---|
| Re. 29,944 | 3/1979 | Hyer et al. . | |
| 1,419,235 | 6/1922 | Desobry . | |
| 1,700,405 | 1/1929 | Guidi . | |
| 1,959,694 | 5/1934 | Stevens . | |
| 2,167,438 | 7/1939 | Kaufman . | |
| 2,443,757 | 6/1948 | Allen . | |
| 2,548,611 | 4/1951 | Maslin . | |
| 2,611,523 | 9/1952 | Aines . | |
| 2,673,019 | 3/1954 | Smith | 141/231 X |
| 2,750,091 | 6/1956 | Mattimoe et al. . | |

(List continued on next page.)

FOREIGN PATENT DOCUMENTS

| | | |
|---|---|---|
| 164075 | 1/1955 | Australia . |
| 80826 | 6/1983 | European Pat. Off. . |
| 303762 | 2/1989 | European Pat. Off. . |
| 2641252 | 7/1990 | France . |
| 2720901 | 11/1978 | Germany . |
| 405272694 | 10/1993 | Japan . |
| 1742131 | 6/1992 | U.S.S.R. . |
| 792749 | 4/1958 | United Kingdom . |
| 2 232 210 | 12/1990 | United Kingdom . |

OTHER PUBLICATIONS

Operators Manual om–5331–70, titled "neumo filler semi–automatic model saf", Cherry–Burrel Corp., Jan. 1972.

Mateer Neotron System Flyer, Neotron System with Microset Control, Series 1200 Semi–Automatic Gravimetric Filler, Jul. 1988.

(List continued on next page.)

*Primary Examiner*—J. Casimer Jacyna

[57] ABSTRACT

A container filling unit moveable from a filling position to cleaning, non-use or ready to use positions including a base and a vertically adjustable mast, which mast provides a manifold and valving system for a single or plurality of filling heads for the precise filling of containers. The unit includes a valving arrangement which provides for full or rapid flow, reduced or slow flow and positive shut-off of flow with the flows being controlled in response to weight or volume of material delivered to the container. The unit includes a turbulence reducing discharge head which includes a positive material shut-off. The unit is useable for surface and subsurface filling and a primary aspect of the invention is to initially fill containers at a rapid rate and thereafter provide a slower filling rate to insure accurate and precise filling. Moveability of the unit allows shifting of the unit from its use, filing location to a cleaning, non-contaminating, controlled conditions location or to a non-use, ready for use location.

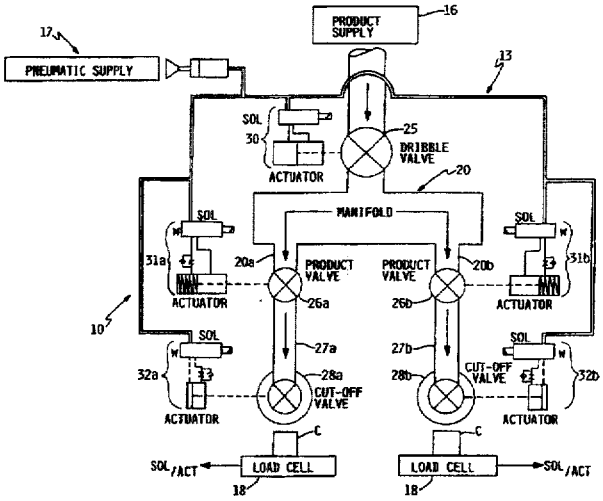

U.S. PATENT DOCUMENTS

| | | | |
|---|---|---|---|
| 2,948,306 | 8/1960 | Kuraeff . | |
| 3,407,890 | 10/1968 | Fellows . | |
| 3,419,052 | 12/1968 | Morine . | |
| 3,484,813 | 12/1969 | Davies . | |
| 3,640,430 | 2/1972 | Roberts | 222/1 |
| 3,670,785 | 6/1972 | Heiss et al. . | |
| 3,785,412 | 1/1974 | Stone . | |
| 3,786,837 | 1/1974 | Pipkins . | |
| 3,797,890 | 3/1974 | Walters . | |
| 3,799,217 | 3/1974 | Bauer | 141/1 |
| 3,920,056 | 11/1975 | Piecuch . | |
| 3,921,682 | 11/1975 | McGahey . | |
| 3,990,212 | 11/1976 | Flodin . | |
| 4,010,595 | 3/1977 | Boyd . | |
| 4,053,001 | 10/1977 | Healey et al. . | |
| 4,059,134 | 11/1977 | Violette . | |
| 4,078,624 | 3/1978 | Bradley . | |
| 4,084,626 | 4/1978 | King . | |
| 4,107,262 | 8/1978 | Lueders et al. | 423/32 |
| 4,111,272 | 9/1978 | Ricciardi et al. . | |
| 4,174,000 | 11/1979 | Milberger | 137/236.1 X |
| 4,195,672 | 4/1980 | Freeman . | |
| 4,208,852 | 6/1980 | Pioch . | |
| 4,211,263 | 7/1980 | Kennedy et al. . | |
| 4,281,729 | 8/1981 | Farley et al. . | |
| 4,300,600 | 11/1981 | Tetenborg et al. . | |
| 4,305,437 | 12/1981 | Greene . | |
| 4,317,475 | 3/1982 | Miller et al. . | |
| 4,337,802 | 7/1982 | Kennedy et al. . | |
| 4,372,352 | 2/1983 | Coppola et al. | 141/1 |
| 4,381,545 | 4/1983 | Biddle, III et al. . | |
| 4,390,049 | 6/1983 | Albertson . | |
| 4,398,577 | 8/1983 | Sauer | 141/135 |
| 4,402,428 | 9/1983 | Lang et al. . | |
| 4,411,295 | 10/1983 | Nutter . | |
| 4,437,498 | 3/1984 | Pankratz et al. . | |
| 4,445,548 | 5/1984 | Neumann . | |
| 4,460,026 | 7/1984 | Hurley et al. . | |
| 4,467,844 | 8/1984 | DiGianfilippo et al. . | |
| 4,469,150 | 9/1984 | Grimaldi . | |
| 4,506,489 | 3/1985 | Schieser et al. . | |
| 4,523,616 | 6/1985 | Kleinophorst et al. . | |
| 4,582,102 | 4/1986 | Risser . | |
| 4,582,150 | 4/1986 | Taylor et al. . | |
| 4,605,047 | 8/1986 | Bausch et al. | 141/83 |
| 4,625,775 | 12/1986 | Schaltegger . | |
| 4,630,654 | 12/1986 | Kennedy, Jr. . | |
| 4,641,693 | 2/1987 | Rakucewicz . | |
| 4,651,788 | 3/1987 | Grosskreuz et al. . | |
| 4,667,708 | 5/1987 | Jernberg . | |
| 4,669,634 | 6/1987 | Leroux . | |
| 4,676,282 | 6/1987 | Bellini et al. . | |
| 4,696,329 | 9/1987 | Izzi . | |
| 4,703,780 | 11/1987 | Reeves, Jr. et al. . | |
| 4,711,277 | 12/1987 | Clish . | |
| 4,735,238 | 4/1988 | Reeves, Jr. . | |
| 4,745,952 | 5/1988 | French | 141/1 |
| 4,763,702 | 8/1988 | High, Jr. et al. . | |
| 4,780,830 | 10/1988 | Omi et al. . | |
| 4,804,024 | 2/1989 | Arnemann . | |
| 4,804,111 | 2/1989 | Ricciardi et al. . | |
| 4,819,700 | 4/1989 | Sommer et al. . | |
| 4,843,579 | 6/1989 | Andrews et al. . | |
| 4,856,563 | 8/1989 | Yamaguchi et al. . | |
| 4,874,049 | 10/1989 | Kee et al. . | |
| 4,913,198 | 4/1990 | Hayahara et al. | 141/83 |
| 4,928,473 | 5/1990 | Nagao et al. . | |
| 4,932,445 | 6/1990 | Biehl . | |
| 4,957,147 | 9/1990 | Lowe . | |
| 4,969,493 | 11/1990 | Lee | 141/38 |
| 5,016,687 | 5/1991 | Kawamura . | |
| 5,052,169 | 10/1991 | Gronlie et al. . | |
| 5,083,591 | 1/1992 | Edwards et al. . | |
| 5,092,414 | 3/1992 | Blezard . | |
| 5,105,859 | 4/1992 | Bennett et al. . | |
| 5,121,775 | 6/1992 | McClain . | |
| 5,143,165 | 9/1992 | Hough . | |
| 5,148,841 | 9/1992 | Graffin . | |
| 5,156,193 | 10/1992 | Baruffato et al. . | |
| 5,168,905 | 12/1992 | Phallen . | |
| 5,234,035 | 8/1993 | Neeser . | |
| 5,265,763 | 11/1993 | Heinrici et al. . | |
| 5,285,825 | 2/1994 | Townsley . | |
| 5,300,736 | 4/1994 | Ehrhardt . | |
| 5,301,488 | 4/1994 | Ruhl et al. . | |
| 5,305,805 | 4/1994 | Watkins, Jr. | 141/231 |
| 5,305,809 | 4/1994 | Pringle . | |
| 5,348,058 | 9/1994 | Ruhl . | |
| 5,379,923 | 1/1995 | Sagastegui et al. . | |
| 5,381,839 | 1/1995 | Dowd . | |
| 5,505,233 | 4/1996 | Roberts et al. . | |

OTHER PUBLICATIONS

Collectively "Thiele Engineering brochures/flyers," published between 1976–1983.

Dry Fillers: Right on the Money, *Packaging*, Jan. 1992, pp. 50–51.

Rotary Pocket Filler, Model PF–11FG, Per–Fil Industries, Product Review, *Packaging*, Feb. 1992, p. 74.

P. 79 of the Sep., 1978 issue of *Package Engineering*.

P. 56 of the Jul., 1979 issue of *Package Engineering*.

P. 96 of the Aug., 1979 issue of *Package Engineering*.

P. 50 of the Oct., 1979 issue of *Package Engineering*.

Pp. 68–69 of the Oct., 1979 issue of *Package Engineering*.

P. 46 of the Dec., 1979 issue of *Package Engineering*.

P. 116 of the Apr., 1980 issue of *Package Engineering*.

P. 97 of the May, 1980 issue of *Package Engineering*.

P. 107 of the May, 1990 issue of *Packaging*.

The Mateer–Burt *Neotron System* brochure (published sometime between 1987–1989).

The Mateer–Burt *Microset Control II Fact Sheet* flyer (published in 1987).

The Mateer–Burt *Platform Scale Feedback Fact Sheet* flyer (published in 1987).

The Mateer–Burt *Series 1900 Single Head Semi–Automatic Filler* flyer (published in 1987).

The Mateer–Burt *Series 1800 Single Head Semi–Automatic Filler* flyer (published in 1989).

The Mateer–Burt *Series 7000 Automatic Top–off Filling System* flyer (published in 1989).

The Matthews *Jet–A–Mark* flyer (published in 1991).

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 2 and 3 are cancelled.

Claims 4 and 7 are determined to be patentable as amended.

Claims 5 and 6, dependent on an amended claim, are determined to be patentable.

New claims 8–15 are added and determined to be patentable.

4. Apparatus for filling containers with liquid products, comprising:

means for defining a filling position for such containers and comprising means supporting such containers, a source of the liquid product to be supplied into the containers and flow means through which the liquid product is supplied, sensing means *disposed at the filling position* for determining the filling of the containers, comprising a plurality of load cells, each for a separate container, a mobile filling unit transportable relative to said filling position, *to said source of liquid product, and to said sensing means* and comprising support wheels rendering the filling unit mobile, said mobile filling unit being transportable to and between said filling position and a cleaning area to be cleaned and made ready for a filling operation, and further comprising a plurality of liquid product dispensing heads for filling a plurality of said containers at said load cells, the mobile filling unit being *removably* connected to said source of liquid product for dispensing the liquid product into the containers and also being *removably* connected to said sensing means when moved from the cleaning area into the filling position for filling of the containers.

7. Apparatus for filling containers with liquid products, comprising:

means defining a filling position for such containers, a source of the liquid product to be supplied into the containers and flow means through which the liquid product is supplied, sensing means comprising load cells at the filling position supporting such containers and determining the filling of the containers, means defining a cleaning area remote from said filling position for flushing and cleaning mobile filling units, first and second mobile filling units transportable relative to said filling position, said mobile filling units comprising movable floor engaging wheels supporting the filling units, said mobile filling units being transportable *relative* to said filling position and load cells and being removable from said filling position and *load cells* to said cleaning area, said first one of said filling units being in said filling position and having a *removable* connection to said source of liquid product and said flow means for dispensing the liquid product into the containers and also having a *removable* connection to said sensing means to determine the filling of the liquid product into the containers, said second one of said filling units being in said cleaning area and remote from said filling position *and load cells* and being readied for operation and for transport to said filling position *and load cells* wherein the second one of the filling units will be subsequently connected to the source of liquid products and to said sensing means for the next filling of such containers, said mobile filling units comprising positioning means releasably retaining the mobile filling units against movement at said filling positions and accommodating subsequent transporting of said mobile filling units to said cleaning area.

*8. Apparatus for filling containers with liquid products, comprising:*

*means defining a filling position for such containers and comprising means supporting such containers,*

*a source of the liquid product to be supplied into the containers and flow means through which the liquid product is supplied,*

*sensing means disposed at the filling position for determining the filling of the containers, comprising a plurality of load cells, each for a separate container,*

*first and second mobile filling units transportable relative to said filling position, to said source of liquid product, and to said sensing means, said mobile filling units comprising movable floor engaging means supporting the filling units, and comprising a plurality of liquid product dispensing heads for filling a plurality of said containers at said plurality of load cells, said mobile filling units being alternately transportable to said filling position and being removable from said filling position and to a cleaning area, said first one of said filling units being in said filling position and having a removable connection to said source of liquid product for dispensing the liquid product into the containers and also having a removable connection to said sensing means to determine the filling of the liquid product into the containers, said second one of said filling units being in said cleaning area and being readied for operation and for transport to said filling position for the next filling of such containers.*

*9. Apparatus for filling containers with liquid products according to claim 8 wherein the floor engaging means comprise support wheels to render the filling unit mobile.*

*10. Apparatus for filling containers with liquid products, comprising:*

*means defining a filling position for such containers and comprising means supporting such containers,*

*a source of the liquid product to be supplied into the containers and flow means through which the liquid product is supplied,*

*sensing means disposed at the filling position for determining the filling of the containers, comprising a plurality of load cells, each for a separate container,*

*first and second mobile filling units transportable relative to said filling position, to said source of liquid product, and to said sensing means, said mobile filling units comprising movable floor engaging means supporting*

*the filling units, and comprising a plurality of liquid product dispensing heads for filling a plurality of said containers at said plurality of load cells, said mobile filling units being alternately transportable to said filling position and being removable from said filling position and to a cleaning area, said first one of said filling units being in said filling position and having a removable connection to said source of liquid product for dispensing the liquid product into the containers and also having a removable connection to said sensing means to determine the filling of the liquid product into the containers and being at all times unconnected to said means supporting such containers, said second one of said filling units being in said cleaning area and being readied for operation and for transport to said filling position for the next filling of such containers.*

*11. Apparatus for filling containers with liquid products according to claim 10 wherein the floor engaging means comprise support wheels to render the filling unit mobile.*

*12. Apparatus for filling containers with liquid products, comprising:*

*means defining a filling position for such containers and comprising means supporting such containers,*

*a source of the liquid product to be supplied into the containers and flow means through which the liquid product is supplied,*

*sensing means disposed at the filling position for determining the filling of the containers, comprising a plurality of load cells, each for a separate container,*

*first and second mobile filling units transportable relative to said filling position, to said source of liquid product, and to said sensing means, said mobile filling units comprising movable floor engaging means supporting the filling units, and comprising a plurality of liquid product dispensing heads for filling a plurality of said containers at said plurality of load cells, said mobile filling units being alternately transportable to said filling position and being removable from said filling position and to a cleaning area, said first one of said filling units being in said filling position and having a removable connection to said source of liquid product for dispensing the liquid product into the containers and also having a removable connection to said sensing means to determine the filling of the liquid product into the containers and not deriving any mechanical power from said means supporting such containers, said second one of said filling units being in said cleaning area and being readied for operation and for transport to said filling position for the next filling of such containers.*

*13. Apparatus for filling containers with liquid products according to claim 12 wherein the floor engaging means comprise support wheels to render the filling unit mobile.*

*14. The apparatus of claim 4, wherein the mobile filling unit is at all times unconnected to the means supporting such containers.*

*15. The apparatus of claim 4, wherein the mobile filling unit derives no mechanical power from the means supporting such containers.*

* * * * *